US010935284B2

(12) United States Patent
Tolouee

(10) Patent No.: US 10,935,284 B2
(45) Date of Patent: Mar. 2, 2021

(54) APPARATUSES AND METHODS FOR MODULAR HEATING AND COOLING SYSTEM

(71) Applicant: Arctic Cool Chillers Limited, Brampton (CA)

(72) Inventor: Changiz Tolouee, Marietta, GA (US)

(73) Assignee: Arctic Cool Chillers Limited, Brampton (CA)

( * ) Notice: Subject to any disclaimer, the term of this patent is extended or adjusted under 35 U.S.C. 154(b) by 151 days.

(21) Appl. No.: 15/875,038

(22) Filed: Jan. 19, 2018

(65) Prior Publication Data

US 2019/0226726 A1 Jul. 25, 2019

(51) Int. Cl.

| | |
|---|---|
| ***F25B 13/00*** | (2006.01) |
| ***F25B 49/02*** | (2006.01) |
| ***F25B 41/00*** | (2006.01) |
| ***F25B 29/00*** | (2006.01) |

(52) U.S. Cl.

CPC ..... *F25B 13/00* (2013.01); *F25B 29/003* (2013.01); *F25B 41/003* (2013.01); *F25B 49/02* (2013.01); *F25B 2313/009* (2013.01); *F25B 2313/027* (2013.01); *F25B 2313/0292* (2013.01); *F25B 2339/047* (2013.01); *F25B 2400/075* (2013.01)

(58) Field of Classification Search

CPC ..... F25B 29/003; F25B 25/005; F25B 2313/027; F25B 2313/02741

See application file for complete search history.

(56) References Cited

U.S. PATENT DOCUMENTS

| | | | | |
|---|---|---|---|---|
| 1,972,704 A * | 9/1934 | Crosthwait, Jr. | ..... | F25B 1/08 62/116 |
| 4,123,914 A * | 11/1978 | Perez | ..... | F25B 5/02 62/196.4 |
| 4,457,358 A * | 7/1984 | Kriege | ..... | F24F 3/06 165/50 |
| 4,962,647 A * | 10/1990 | Kuwahara | ..... | F25B 1/10 62/156 |

(Continued)

FOREIGN PATENT DOCUMENTS

| | | |
|---|---|---|
| EP | 1811246 A1 | 7/2007 |
| EP | 1826509 A2 | 8/2007 |
| WO | 2014/143194 A1 | 9/2014 |

OTHER PUBLICATIONS

Extended European Search Report; European Patent Application No. 19152398.4, dated Jun. 19, 2019 (8 pages).

*Primary Examiner* — Jianying C Atkisson
*Assistant Examiner* — Jose O Class-Quinones
(74) *Attorney, Agent, or Firm* — Hamre, Schumann, Mueller & Larson, P.C.

(57) ABSTRACT

Modular heating and cooling systems may include one or more modules connected to a fluid input and fluid output. A modular heating system includes at least one heating and cooling apparatus. The apparatus includes a first heat exchanger, a second heat exchanger and a third heat exchanger. The apparatus further includes a refrigerant line system coupled to the first (e.g. cooling), second (e.g. heating) and third (e.g. source) heat exchangers and configurable for selectively directing refrigerant fluid through the heat exchanger to provide multiple modes of operation. The heating, cooling and source fluid loops may be separate and independent such that the fluids do not mix.

21 Claims, 11 Drawing Sheets

(56) References Cited

U.S. PATENT DOCUMENTS

| | | | | |
|---|---|---|---|---|
| 5,239,835 | A * | 8/1993 | Kitaguchi | F25B 1/00 62/217 |
| 6,470,693 | B1 * | 10/2002 | Dickey | B01D 5/0039 62/402 |
| 6,668,572 | B1 * | 12/2003 | Seo | F24D 17/02 237/2 B |
| 7,412,838 | B2 * | 8/2008 | Hamanaka | F25B 5/04 62/115 |
| 7,530,235 | B2 * | 5/2009 | Yamaguchi | F01K 7/16 60/671 |
| 9,708,825 | B1 | 7/2017 | Delgado et al. | |
| 2004/0107717 | A1 * | 6/2004 | Yoon | F24F 11/62 62/230 |
| 2012/0111039 | A1 * | 5/2012 | Allen | F25B 29/003 62/115 |

* cited by examiner

APPARATUSES AND METHODS FOR MODULAR HEATING AND COOLING SYSTEM

FIELD OF THE DISCLOSURE

This disclosure relates to heating and cooling systems. More particularly, the disclosure relates to modular heating and cooling systems comprising one or more heat exchangers and fluid loops.

BACKGROUND

Heating and cooling systems, such as air conditioner systems for interior spaces, typically include heat exchangers and fluid that is cycled through the heat exchangers to provide the required heating and/or cooling. Examples of typical heat exchangers include evaporators and condensers.

Modular heating and cooling systems may include one or more modules connected to a fluid input and fluid output. A module of a conventional modular system typically consists of two heat exchangers: a first heat exchanger dedicated as an evaporator to cool a "cooling" or "cold" fluid; and the second heat exchanger functioning as a condenser to provide heat to a "heating" or "hot" fluid. This set up is similar to a basic refrigeration cycle. A "source" fluid may also provide either heat or cooling to the system by acting as heat source or heat sink. In some cases, reversing valves are used to reverse the refrigerant cycle between evaporator and condenser heat. In conventional systems, control valves are typically used to switch the liquid flow among the heating fluid, cooling fluid and source fluid depending on the load requirement.

Various conventional fluid switching methods used in these scenarios include three-way valves, two-way valves and varying end caps. These conventional methods result in mixing of the cooling, heating and source fluids. As a result, such systems require these three liquid loops to be of the same type of solution. As an example, if one fluid loop requires glycol mix at certain percentage (e.g. because the fluid loop is partially outdoors), the other fluid loops must be the same percentage glycol. This may cause inefficiencies in the system because glycol solutions are typically less effective for heat transfer, and more expensive, than water without glycol.

SUMMARY

According to one aspect, there is provided a heating and cooling apparatus comprising: a first heat exchanger, a second heat exchanger and a third heat exchanger; a compressor; a first fluid line for a first fluid coupled to the first heat exchanger; a second fluid line for a second fluid coupled to the second heat exchanger; a refrigerant line system coupled to the first, second and third heat exchangers and configurable to: direct refrigerant fluid through the first and third heat exchangers and the compressor, to cool the first fluid, in a first mode of operation; direct the refrigerant fluid through the second and third heat exchangers and the compressor, to heat the second fluid, in a second mode of operation; and direct the refrigerant fluid through the first and second heat exchangers and the compressor, to cool the first fluid and heat the second fluid, in a third mode of operation.

In some embodiments: the refrigerant line system is configurable, for the first mode of operation, to direct the refrigerant through the third heat exchanger in a first flow direction such that the third heat exchanger functions as a heat sink; and the refrigerant line system is configurable, for the second mode of operation, to direct the refrigerant through the third heat exchanger in a second flow direction such that the third heat exchanger functions as a heat source.

In some embodiments, the first fluid line and the second fluid line are independent and separate from the one another, thereby maintaining separation of the first and second fluids.

In some embodiments: the first fluid line comprises a first fluid input connectable to a first fluid-in pipeline and a first fluid output connectable to a first fluid-out pipeline; and the second fluid line comprises a second fluid input connectable to a second fluid-in pipeline and a second fluid output connectable a second fluid-out pipeline.

In some embodiments, the heating and cooling apparatus is further operable in a standby mode of operation.

In some embodiments, each of the first, second and third fluid lines comprises a respective valve to control flow therethrough.

In some embodiments, the apparatus further comprises a control module connected to the refrigerant line system and operable to select between the modes of operation.

In some embodiments, the refrigerant line system comprises a plurality of interconnected refrigerant line segments and a plurality of valves configurable to provide: a first refrigerant loop for the first mode of operation; a second refrigerant loop for the second mode of operation; and a third refrigerant loop for the third mode of operation.

In some embodiments, the control module is connected to and controls the plurality of valves.

In some embodiments, the first mode of operation is a cooling-only mode of operation, the second mode of operation is a heating-only mode of operation, and the third mode of operation is a concurrent heating and cooling mode of operation.

In some embodiments, the third heat exchanger is an air coil heat exchanger.

In some embodiments, the apparatus further comprises a third fluid line for a third fluid coupled to the third heat exchanger such that the third fluid absorbs heat from the refrigerant fluid in the first mode of operation and the third fluid provides heat to the refrigerant fluid in the second mode of operation.

In some embodiments, at least one of the first, second and third fluids is substantially glycol free water, and at least one other of the first, second and third fluids is a glycol solution.

In some embodiments, at least one of the first, second and third fluid lines comprises a respective cleanable strainer upstream of the corresponding first, second or third heat exchanger.

According to another aspect, there is provided a heating and cooling system comprising: at least one heating and cooling apparatus as claimed in claim 1, each heating and cooling apparatus connectable to the first fluid-in pipeline, the first fluid-out pipeline, the second fluid-in pipeline and the second fluid-out pipeline.

In some embodiments, each at least one said heating and cooling apparatus further comprising a third fluid line, for a third fluid, coupled to the third heat exchanger such that the third fluid absorbs heat from the refrigerant fluid in the first mode of operation and the third fluid provides heat to the refrigerant fluid in the second mode of operation, wherein the third fluid line is connectable to a third fluid-in pipeline, a third fluid-out pipeline.

In some embodiments, a current mode of operation of the plurality of modes of operation is independently selectable for each said at least one heating and cooling apparatus.

According to another aspect, there is provided a method for making a heating and cooling apparatus comprising: coupling a first fluid line to a first heat exchanger; coupling a second fluid line to a second heat exchanger; coupling a refrigerant line system to the first and second heat exchangers and to a third heat exchanger, wherein the refrigerant line system is configurable to: direct refrigerant fluid through the first and third heat exchangers and the compressor for cooling the first fluid in a first mode of operation; direct refrigerant the fluid through the second and third heat exchangers and the compressor for heating the second fluid in a second mode of operation; and direct refrigerant fluid through the first and second heat exchangers and the compressor for cooling the first fluid and heating the second fluid for a third mode of operation.

In some embodiments, the method further comprises: for a first mode of operation, configuring the refrigerant line system to direct the refrigerant through the third heat exchanger in a first flow direction such that the third heat exchanger functions as a heat sink; and the refrigerant line system is configured, in the second mode of operation, to direct the refrigerant through the third heat exchanger in a second flow direction such that the third heat exchanger functions as a heat source, the second flow direction being the reverse of the first flow direction.

In some embodiments, the method further comprises interconnecting a plurality of refrigerant line segments and a plurality of valves to provide the refrigerant line system that provides a first refrigerant loop for the first mode of operation; a second refrigerant loop for the second mode of operation; and a third refrigerant loop for the third mode of operation.

Other aspects and features of the present disclosure will become apparent to those ordinarily skilled in the art upon review of the following description of the specific embodiments of the disclosure.

BRIEF DESCRIPTION OF THE DRAWINGS

The present disclosure will be better understood having regard to the drawings in which.

DETAILED DESCRIPTION

Figure 1:
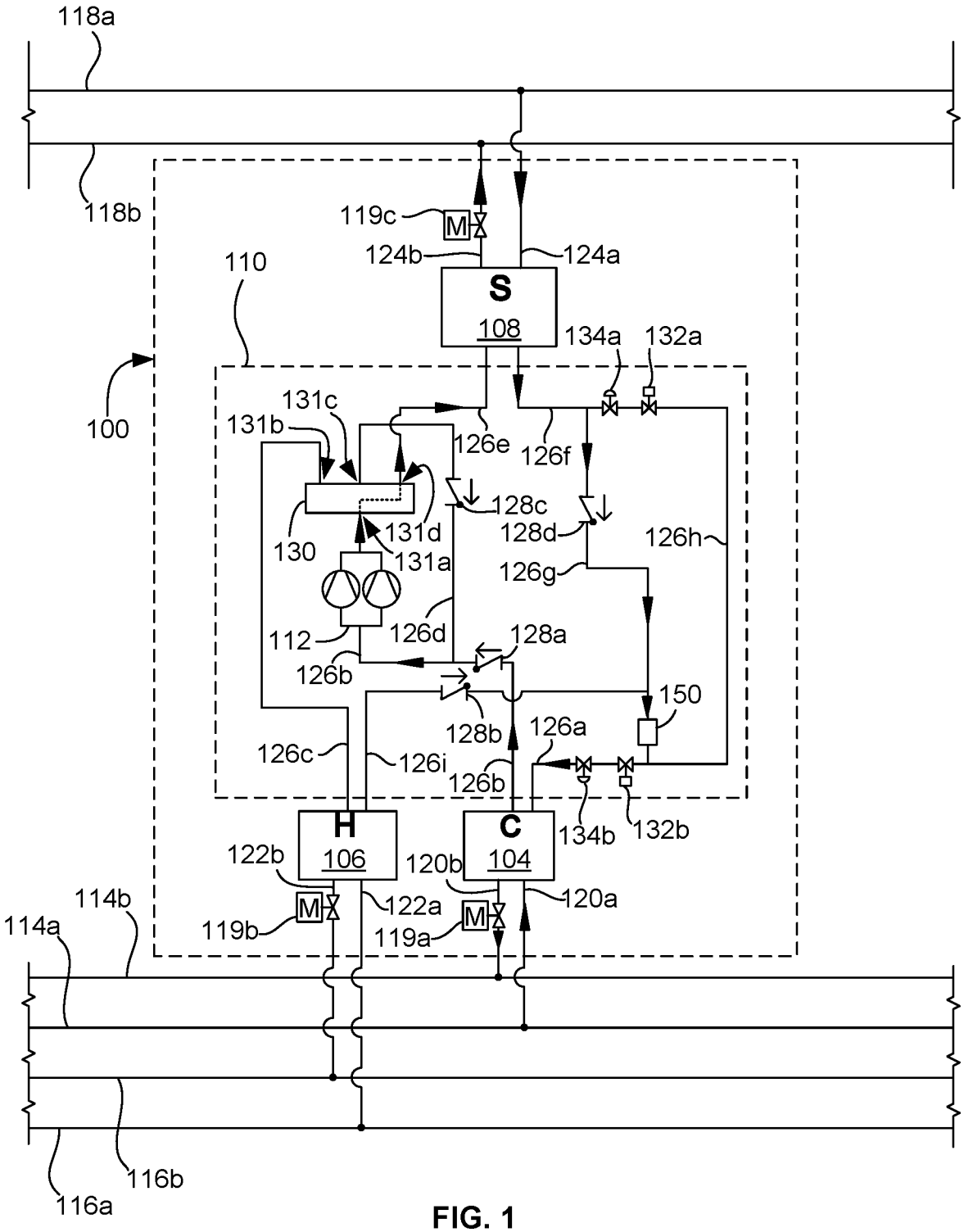
FIG. 1 is a block diagram of an example heating and cooling apparatus according to some embodiments operating in a cooling-only mode of operation.

As discussed above, conventional modular heating and cooling systems use the same fluid mixture for heating and cooling cycles. According to some embodiments of the disclosure, there is provided a modular versatile thermal system comprising dedicated and independent heating and cooling fluid loops, such that the heating and cooling fluids do not need to mix.

The modular heating and cooling system described herein comprises one or more heating and cooling apparatuses (i.e. modules) that may each be independently set to: heating-only mode of operation; cooling-only mode of operation; and concurrent heating and cooling mode of operation.

The heating and cooling apparatuses may be independently and individually set to one of the modes of operation to satisfy the cooling and heating requirements of a building or process. In other words, each heating and cooling apparatus may be set to any one of the three modes of operation at any given time, thereby providing flexibility in matching the required heating and/or cooling capacity any time.

The terms "heating-only", "cooling-only" and "concurrent heating and cooling" refer to the heating and cooling of the respective heating/cooling fluids in the heating and cooling loops. The term "cooling-only" simply refers to cooling of the cooling fluid (with the heating fluid not being heated by the apparatus in that mode). Similarly, "heating-only" simply refers to heating of the heating fluid (with the cooling fluid not being cooled by the apparatus in that mode). These terms do not mean that no heat is radiated or absorbed at other stages of the refrigeration cycle. These modes of operation may also be referred to as "first, second and third" modes of operation. Similarly, the heating fluid and cooling fluid may be referred to as "first" and "second" fluids. Furthermore, embodiments are not limited to the particular "heating-only", "cooling-only" and "concurrent heating and cooling" modes of operation described herein.

For each heating and cooling apparatus, the cooling fluid loop is coupled to a first heat exchanger (e.g. evaporator) configured for cooling. The heating fluid loop is coupled to a second heat exchanger (e.g. condenser) configured for heating. The apparatus also includes a third heat exchanger, which may act as a heat source for the heating-only mode of operation and may also act as a heat sink for the cooling-only mode of operation. The system further includes a refrigerant line system that selectively directs flow of a refrigerant fluid to the first, second and third heat exchangers. The function of selectively directing flow may be accomplished with a set of valves controlled by the apparatus. The refrigerant line system may be configured to reverse the flow of direction of the refrigerant through the third heat exchanger to select between the heat sink and heat source function. In other words, the refrigerant line system is configurable to provide different refrigerant loops for the different modes of operation.

In the cooling-only mode of operation, the refrigerant loop is set to flow through the first heat exchanger, to cool the cooling fluid, and the third heat exchanger, with the third heat exchanger acting as a heat sink. In the heating-only mode of operation, the refrigerant loop is set to flow through the second heat exchanger, to heat the heating fluid, and the third heat exchanger, with the third heat exchanger acting as a source. In the concurrent cooling and heating mode of operation, the refrigerant loop is set to flow through the first heat exchanger, to cool the cooling fluid, and the second heat exchanger, to heat the heating fluid. The various modes of operation may be selected and controlled by configuring the set of valves (e.g. solenoid/motorized valves and reversing valve).

According to an aspect, the heating, cooling, and source loops are separate and independent such that the heating fluid, the cooling fluid and the source fluid (if present) do not mix. In conventional systems where the fluids mix, a single fluid (typically containing a percentage of glycol) is used for the heating, cooling and source loops. By providing separate, independent fluid loops, according to the present disclosure, different fluids may be used in different loops. This may, for example, eliminate the need for unnecessarily filling loops with glycol. This, in turn, may result in greater efficiency advantages due to the fact that water (without glycol) may be better heat transfer efficiency than glycol and may have a lower cost.

FIG. 1 is a functional block diagram of an example heating and cooling apparatus 100 according to some embodiments. The apparatus 100 may form a module of a modular heating and cooling system, such as the system 1000 shown in FIG. 10. Multiple such apparatuses may have arranged to work together in the modular system to provide desired heating and cooling (e.g. in a building and/or process).

The heating and cooling apparatus 100 has the following modes of operation: (1) cooling-only; (2) heating-only; (3) concurrent cooling and heating; and optionally (4) standby. Other modes of operation may be implemented as well. The heating and cooling apparatus 100 is shown operating in the cooling-only mode of operation in FIG. 1.

The heating and cooling apparatus 100 includes a first heat exchange module 104 for cooling a cooling fluid and a second heat exchange module 106 for heating a heating fluid. By way of example, the first heat exchange module 104 may comprise an evaporator, and the second heat exchange module 106 may comprise a condenser. The heating and cooling apparatus 100 further includes a third "source" heat exchange module 108 that acts as either a heat sink or a heat source depending on the current mode of operation of the heating and cooling apparatus 100. The heating and cooling apparatus 100 further includes a refrigerant line system 110 with multiple refrigerant loop configurations. The refrigerant line system 110 is configurable to select between the modes of operation, as will be described in detail below.

FIG. 1 also shows example cooling fluid-in pipeline 114*a*, cooling fluid-out pipeline 114*b*, heating fluid-in pipeline 116*a*, heating fluid-out pipeline 116*b*, source fluid-in pipeline 118*a* and source fluid-out pipeline 118*b* to which the apparatus 100 is connected.

Cooling fluid (not visible) flows into the first heat exchange module 104 (via cooling fluid input 120*a*) from the cooling fluid-in pipeline 114*a* and exits from the first heat exchange module 104 (via cooling fluid output 120*b*) to the cooling fluid-out pipeline 114*b*.

Similarly, heating fluid (not visible) flows into the second heat exchange module 106 (via heating fluid input 122*a*) from the heating fluid-in pipeline 116*a* and exits from the second heat exchange module 106 (via heating fluid output 122*b*) to the heating fluid-out pipeline 116*b*.

Source fluid (not visible) flows into the third heat exchange module 108 (via source fluid input 124*a*) from the source fluid-in pipeline 118*a* and exits from the third heat exchange module 108 (via source fluid output 124*b*) to the source fluid-out pipeline 118*b*.

The fluid-in and fluid-out pipelines 114*a*, 114*b*, 116*a*, 116*b*, 118*a* and 118*b* may be referred to as "header pipes" or "header pipelines". Flow of the cooling, heating and source fluids through the corresponding heat exchange modules 104, 106 and 108 is controlled by valves 119*a*, 119*b* and 119*c* respectively, as discussed below. The valves 119*a*, 119*b* and 119*c* are motorized valves in this example embodiment, although embodiments are not limited specifically to motorized valves. For example, solenoid (e.g. solenoid piloted), pneumatic or other types valves or other flow control means may be used in other embodiments.

The cooling, heating, and source lines within the apparatus 100 are independent such that the cooling, heating, source fluids do not mix. Thus, different fluids may be used for different lines. At least one of the cooling, heating and source fluids may be substantially glycol free water, and at least one other of the cooling, heating and source fluids may be a glycol solution. For example, the source fluid may be a glycol solution, while the heating liquid and the cooling liquid may each be water (glycol free). The heating and cooling fluids may alternatively be different. As yet another option, each of the cooling, heating and source fluids may be glycol-free water, or each may comprise a glycol solution. Other fluid solutions and combinations are also possible. Water may be cheaper and better for heat exchange, while a glycol solution may resist freezing and be more suitable for source pipelines that extend into outdoor areas.

The apparatus 100 includes a compressor 112 which is shown as part of the refrigerant line system 110 in this embodiment. In other embodiments, the compressor 112 may be external to and connected to the refrigerant line system 110. The refrigerant line system 110 controls the flow of the refrigerant through the corresponding heat exchangers 104, 106 and 108 and the compressor 112, as discussed in more detail below. The compressor 112 shown in FIG. 1 is a tandem compressor, although embodiments are not limited to any particular compressor type. The compressor 112 may also be single, multiple in tandem, cascade, in series, parallel, fixed speed or variable speed.

The refrigerant line system 110 is configurable to selectively direct refrigerant fluid through the heat exchange modules 104, 106 and 108 and the compressor 112 depending on the selected mode of operation. In this specific example, the refrigerant line system 110 includes refrigerant line segments 126*a* to 126*i* and valves 128*a* to 128*d*, 130, 132*a*, 132*b*, 134*a* and 134*b* interconnecting the heat exchange modules 104, 106 and 108 and the compressor 112. The refrigerant line segments 126*a* to 126*i* may comprise pipes, other tubing and/or other structure suitable for conveying the refrigerant fluid. The specific arrangement and function of the line segments 126*a* to 126*i* and valves 128*a* to 128*d*, 130, 132*a*, 132*b*, 134*a* and 134*b* will be discussed in more detail below. However, it is to be understood that embodiments are not limited to the particular components and arrangement of the example refrigerant line system 110. Refrigerant line systems of other embodiments may comprise other arrangements of fluid lines and flow control devices to selectively direct the refrigerant for different modes of operations.

Refrigerant line segment 126*a* extends into the first heat exchange module 104.

Refrigerant line segment 126*b* extends (as output) from the first heat exchange module 104 to an input of the compressor 112. Refrigerant line segment 126*b* the continues from the output of the compressor 112 to a first port 131*a* of the reversing valve 130. The reversing valve 130 has multiple flow configuration settings.

Refrigerant line segment 126*c* extends from a second port 131*b* of the reversing valve 130 and into the second heat exchange module 106.

Refrigerant line segment 126*d* extends from a third port 131*c* of the reversing valve 130 back to the refrigerant line segment 126*b* upstream of the compressor 112.

Refrigerant line segment 126*e* extends from a fourth port 131*d* of the reversing valve and into the third heat exchange module 108.

Refrigerant line segment 126*f* extends (as output) from the third heat exchange module 108 and then continues as line segment 126*g*.

Refrigerant line segment 126*g* extends through optional filter dryer 150 and continues thereafter to connect with segments 126*a* and 126*h*.

Refrigerant line segment 126*h* extends from the connection point of segments 126*a* and 126*g* back to an intersection/connection with line segments 126*f* and 126*g* (upstream of one-way check valve 128*d* discussed below).

Refrigerant line segment 126*i* extends (as output) from the second heat exchange module 106 to join line segment 126*g* upstream of the filter dryer 150.

One-way check valves 128*a*, 128*b*, 128*c* and 128*d* are included on refrigerant fluid line segments 126*b*, 126*i*, 126*d* and 126*g* respectively. The check valves 128*a*, 128*b*, 128*c* and 128*d* limit the flow of the refrigerant fluid therein to a single direction as indicated by small arrows. As mentioned above, embodiments are not limited to particular types of valves or valve arrangements. In other embodiments, different valves (one-way or otherwise) and/or different flow control means may be used in addition to, or in place of, the one-way check valves of this specific example.

First and second valves 132*a* and 132*b* are included on line segments 126*h* and 126*a* respectively) and may be opened or closed to turn on/off the flow through the corresponding line segments 126*h* and 126*a* respectively. The valves 132*a* and 132*b* are solenoid valves that are controlled electrically in this example. However, other valve types (e.g. motorized, pneumatic, etc.) or other flow control means may be used to turn flow on/off, and embodiments are not limited to solenoid valves.

First and second expansion valves 134*a* and 134*b* are located just downstream of the solenoid valves 132*a* and 132*b*, respectively. The expansion valves can of any type of valves to perform the function. By way of example, the valves may be thermal expansion valves (known as T-X valves) or electronic expansion valves or any other flow metering device adjusted by the system controller. The expansion valves 134*a* and 134*b* cause expansion of refrigerant fluid flowing there though to create a boiling mixed gas/liquid state for the refrigeration cycle.

The refrigerant line system 110 in this example also includes a reversing valve 130 that controls the flow of fluids between line segments 126*b*, 126*c*, 126*d* and 126*e*, as explained in more detail below. The reversing valve 130 may be activated by a motor 163 (or alternatively a solenoid) through commands received from the system controller. In other embodiments, rather than a single reversing-type valve, a combination of other valves may be used to perform the reversing valve function.

Figure 2:
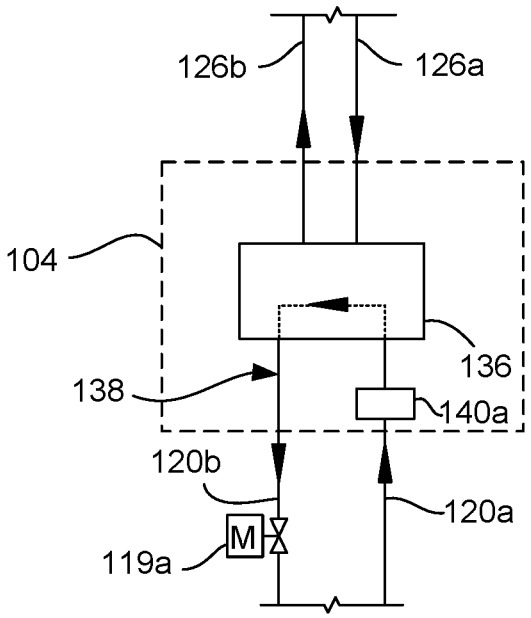
FIG. 2 is a block diagram of a first (cooling) heat exchange module of the apparatus of FIG. 1 according to some embodiments.

FIG. 2 is a block diagram of the first (cooling) heat exchange module 104 in FIG. 1. The heat exchange module 104 includes a first heat exchanger 136 (e.g. evaporator). Refrigerant may flow into the first heat exchanger 136 via refrigerant line segment 126*a* and exit the first heat exchanger 136 via refrigerant line segment 126*b*. The cooling fluid flows through a cooling fluid line 138, which includes the cooling fluid input 120*a* and output 120*b*. Flow through the cooling fluid line 138 may be turned on/off by opening or closing valve 119*a*.

The cooling fluid line 138 is coupled to the first heat exchanger 136 for giving heat to the refrigerant fluid. For example, in the case of an evaporator, the process of the refrigerant fluid evaporating requires the refrigerant fluid to absorb heat, thereby cooling the cooling fluid. The cooling fluid line 138 is separate from and does not mix with the refrigerant fluid in the heat exchanger 136 (indicated by the stippled line portion of the cooling fluid line 138). The cooling fluid line 138 and the cooling fluid-in and fluid out pipelines 114*a* and 114*b* (shown in FIG. 1) are typically, but not necessarily in all embodiments, part of a closed loop. By way of example, the cooling fluid-in and fluid out pipelines 114*a* and 114*b* may both be in fluid communication with a cooling fluid reservoir.

The cooling fluid line 138 may comprise tubing (e.g. pipe, hose, etc.) and/or any other structure suitable for conveying the cooling fluid. The thermal coupling of the cooling fluid line and the first heat exchanger 136 may be accomplished in any suitable manner. For example, the cooling fluid line may have one or more coils (not shown) around, within, or adjacent to the refrigerant path in the first heat exchanger 136.

FIG. 2 also shows optional strainer 140*a* in the cooling fluid line 138 (upstream of the first heat exchanger 136) for straining debris from the cooling fluid. The strainer 140*a* may be accessible for cleaning to periodically remove the strained debris.

Figure 3:
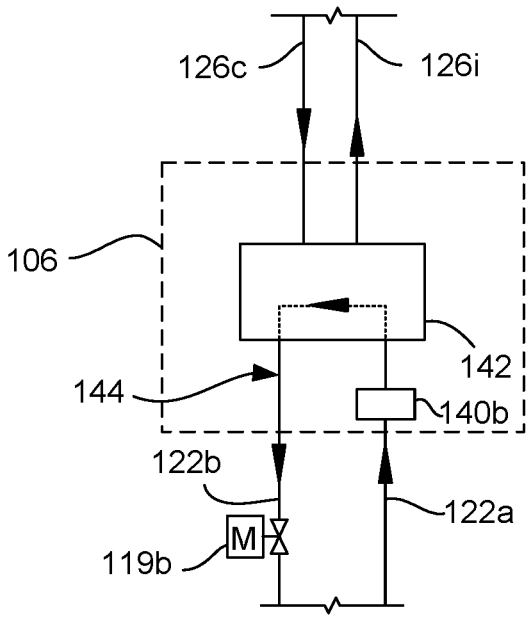
FIG. 3 is a block diagram of a second (heating) heat exchange module of the apparatus of FIG. 1 according to some embodiments.

FIG. 3 is a block diagram showing additional detail of the second (heating) heat exchange module 106 in FIG. 1. The second heat exchange module 106 includes a second heat exchanger 142 (e.g. condenser). Refrigerant fluid may flow into the second heat exchanger 142 via refrigerant line segment 126*c* and exit the second heat exchanger 142 via refrigerant line segment 126*i*. The heating fluid flows through a heating fluid line 144, which includes the heating fluid input 122*a* and output 122*b*. Flow of the heating fluid through the heating fluid line 144 may be turned on/off by opening or closing valve 119*b*

The heating fluid line 144 is coupled to the second heat exchanger 142 for absorbing heat from the refrigerant fluid. For example, in the case of a condenser, the process of the refrigerant fluid condensing requires the refrigerant fluid to radiate heat, thereby heating the heating fluid. The heating fluid line 144 and the heating fluid-in and fluid out pipelines 116*a* and 116*b* (shown in FIG. 1) are typically, but not necessarily in all embodiments, part of a closed loop. By way of example, the heating fluid-in and fluid out pipelines 116*a* and 116*b* may both be in fluid communication with a heating fluid reservoir.

The heating fluid line 144 may comprise tubing (e.g. pipe, hose, etc.) and/or other structure suitable for conveying the heating fluid. The thermal coupling of the heating fluid line 144 and refrigerant fluid in the second heat exchanger 142 may be accomplished in any suitable manner. For example, the heating fluid line 144 may comprise one or more coils (not shown) around, within, or adjacent to the second heat exchanger 142.

FIG. 3 also shows optional strainer 140*b* in the heating fluid line 144 (upstream of the second heat exchanger 142) for straining debris from the heating fluid. The strainer 140*b* may be accessible to periodically remove the strained debris.

Figure 4:
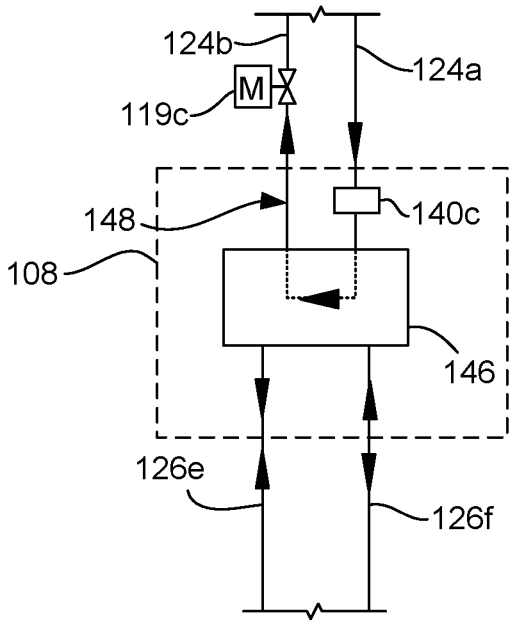
FIG. 4 is a block diagram of a third (source) heat exchange module of the apparatus of FIG. 1 according to some embodiments.

FIG. 4 is a block diagram showing additional detail of the third (source) heat exchange module 108 in FIG. 1. The third heat exchange module 108 includes a third heat exchanger 146 that acts as a heat sink (e.g. condenser) or a heat source (e.g. evaporator) depending on the direction of flow of the refrigerant fluid, which is reversible. The refrigerant fluid may flow into the third heat exchanger 146 via refrigerant line segment 126*e* and exit the third heat exchanger 146 via refrigerant line segment 126*f*, or vice versa depending on the flow direction. The source fluid flows through a source fluid line 148, which includes the source fluid input 124*a* and output 124*b*. Flow of the source fluid through the source fluid line 148 may be turned on/off by opening or closing the valve 119*c*. Other types of valves also can be used.

The source fluid line 148 is coupled to the third heat exchanger 146. If the third heat exchanger 146 is functioning as a heat sink, heat is absorbed from the refrigerant fluid into the source fluid. Conversely, if the third heat exchanger 146 is functioning as a heat source, heat is absorbed from the source fluid into the refrigerant fluid. The source fluid line 148 and the source fluid-in and fluid-out pipelines 118*a* and 118*b* (shown in FIG. 1) are typically, but not necessarily in all embodiments, part of a closed loop. By way of example, the source fluid-in and fluid out pipelines 118*a* and 118*b* may both be in fluid communication with a source fluid reservoir. The source fluid loop can be fed by geothermal loop, cooling tower, boiler, etc.

The source fluid line 148 may comprise tubing (e.g. pipe, hose, etc.) and/or other structure suitable for conveying the heating fluid. The thermal coupling of the source fluid line 148 and the third heat exchanger 146 may be done in any suitable manner. For example, the source fluid line 148 may comprise one or more coils (not shown) around, within, or adjacent to the second heat exchanger 142.

FIG. 4 also shows optional strainer 140*c* in the source fluid line 148 (upstream of the third heat exchanger 146) for straining debris from the source fluid. The strainer 140*c* may be accessible to periodically remove the strained debris.

The terms "first heat exchange module," "second heat exchange module" and "third heat exchange module" used herein are for ease of description of functionality and do not require that the modules be separately housed or spatially segregated from the remainder of the heating and cooling apparatus 100 of FIG. 1. In some embodiments, a "heat exchange module" may simply comprise a heat exchanger with the corresponding fluid lines coupled thereto. For example, the first heat exchanger 104 shown in FIGS. 1 and 2 may consist of the first heat exchanger 136 coupled to the first fluid line 138 and the refrigerant line system 110.

Figure 5:
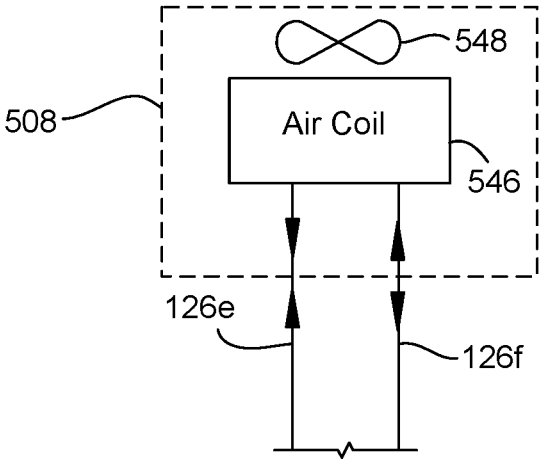
FIG. 5 is a block diagram showing another example of a third (source) heat exchange module according to some embodiments.

FIG. 5 is a block diagram showing an optional configuration of a third (source) heat exchange module 508 for some embodiments. Rather than a source fluid, an air-coil type heat exchanger 546 with optional fan 548 is used. In this example, air is either a cool source for cooling the refrigerant fluid or a heat source for heating the refrigerant fluid depending on the flow direction of the refrigerant fluid.

Turning again to FIG. 1, the cooling-only mode of operation will now be described. In this mode of operation, the refrigerant line system 110 creates a refrigeration cycle/loop with the first and third heat exchange modules 104 and 108 (with the second heat exchange module 106 inactive). Arrows on the relevant refrigerant line segments are shown to illustrate the direction of flow of the refrigerant fluid, cooling fluid and source fluid. Accumulator/s may be included (installed) on the suction line 126*b* position. Liquid receiver/s may be included (installed) on the liquid line upstream or downstream of the filter dryer 150.

The first solenoid valve 132*a* is closed to prevent refrigerant fluid from flowing through refrigerant line segment 126*h*. The second solenoid valve 132*b* is opened to allow flow through refrigerant line segment 126*a*. As a result, refrigerant at or near boiling (due to expansion valve 134*b*) flows into the first heat exchange module 104 where it evaporates in the first heat exchanger 136 (FIG. 2) and absorbs heat from the cooling liquid. The refrigerant fluid the exits the first heat exchange module 104 and travels to the compressor 112 via refrigerant line segment 126*b* where it is compressed into a heated liquid and continues on to the reversing valve 130.

The reversing valve 130 is set to a first setting (referred to herein as "setting 1") to direct the refrigerant fluid via refrigerant line segment 126*e* into the third heat exchange module 108 where it transfers heat to the source fluid. More specifically, the refrigerant passes through the third heat exchanger 146 shown in FIG. 5, which functions as a condenser heat sink in this mode. The cooled refrigerant then travels back toward the expansion valve 134*b* via refrigerant line segments 126*f* and 126*g*. The refrigerant also passes through the filter dryer 150. Filter dryer in refrigeration system may have two functions: adsorb contaminants like moisture; and provide physical filtration.

In this cooling-only mode of operation, the valves 119*a* and 119*c* are opened so that the cooling fluid and source fluids flow through the first and third heat exchange modules 104 and 108 respectively. The cooling fluid enters from cooling fluid-in pipeline 114*a* and is cooled in the first heat exchange module 104 before exiting to the cooling fluid-out pipeline 114*b*. Heat is vented to the source fluid in the third heat exchange module 108 as described above.

The valve 119*b* may be closed so that heating fluid does not flow through the second heat exchange module 106, which is inactive in this mode.

Figure 6:
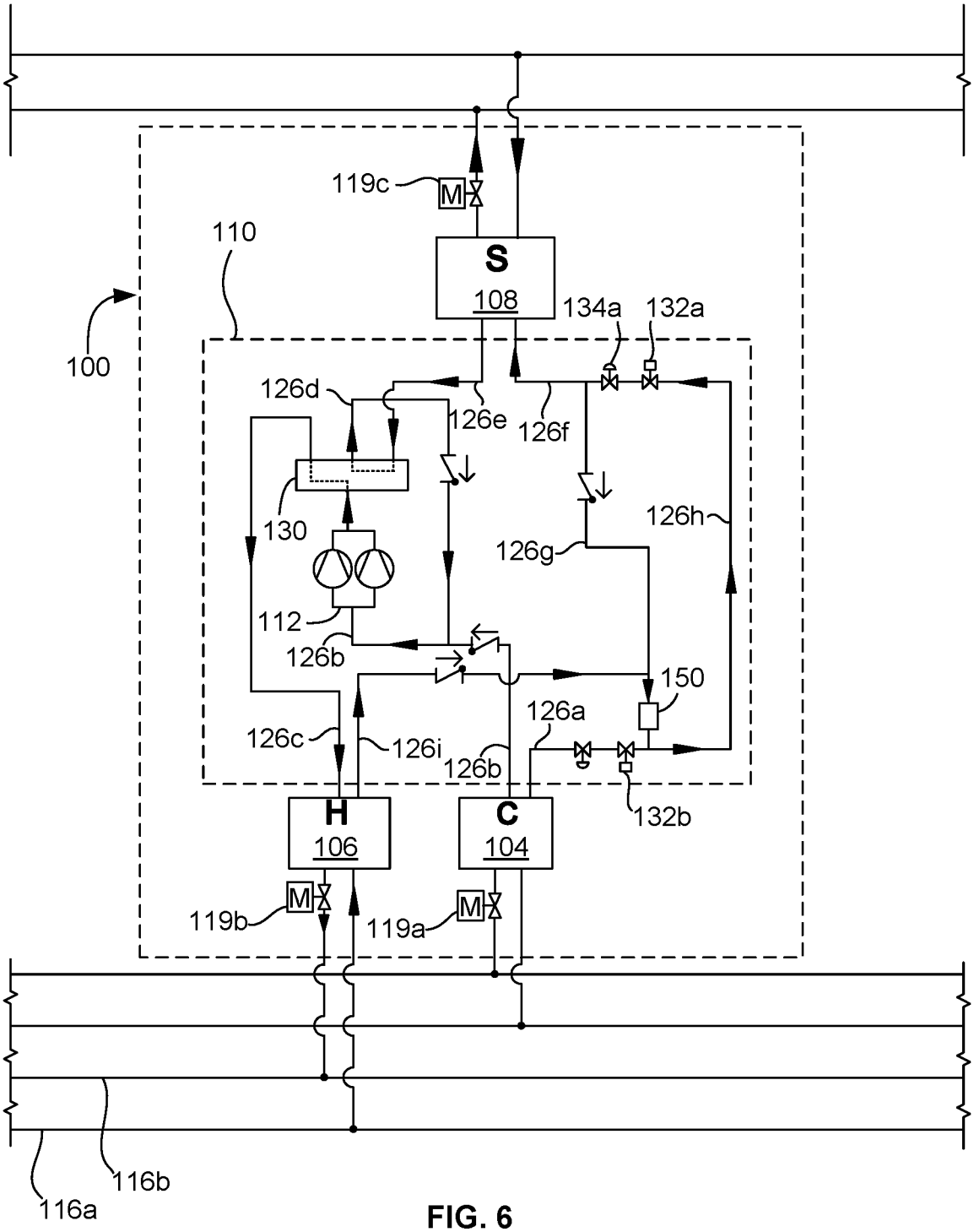
FIG. 6 is the block diagram of the apparatus of FIG. 1, but operating in a heating-only mode of operation.

FIG. 6 is the block diagram of FIG. 1, but in the heating-only configuration. In this mode of operation, the refrigerant line system 110 creates a refrigeration cycle using the second and third heat exchange modules 106 and 108 (with the first heat exchange module 104 inactive). Arrows on the relevant refrigerant line segments are shown to illustrate the direction of flow of the refrigerant fluid, heating fluid and source fluid.

The first solenoid valve 132*a* is opened to allow refrigerant fluid to flowing through refrigerant line segment 126*h*. The second solenoid valve 132*b* is closed to prevent flow through refrigerant line segment 126*a*. As a result, cooled refrigerant fluid exits from the second heat exchange module 106 on refrigerant line segment 126*i* and then along a portion of refrigerant line segment 126*g* through the filter dryer 150. The refrigerant fluid then travels through the expansion valve 134*a* and into the third heat exchanger 108 (via line segment 126*f*), which acts as an evaporator-heat sink for this flow direction. The refrigerant evaporates, thereby absorbing heat from the source fluid. The refrigerant fluid then flows from the third heat exchanger 108 along line segment 126*e* to the reversing valve 130.

In this mode of operation, the reversing valve 130 is set to a second setting (referred to herein as "setting 2") to re-direct the refrigerant fluid to line segment 126*d*. The refrigerant fluid then travels along a portion of line segment 126*b* and into the compressor 112.

The refrigerant fluid (now in heated gas form) exits the compressor 112 and is directed by the reversing valve 130 to line segment 126*c* where it re-enters the second heat exchanger 106. In the second heat exchanger 106, the refrigerant fluid travels through the second heat exchanger 142 (FIG. 3) and transfers heat to the heating fluid.

In this heating-only mode of operation, the valves 119*b* and 119*c* are opened so that the heating fluid and source fluids flow through the second and third heat exchange modules 106 and 108 respectively. The heating fluid enters from heating fluid-in pipeline 116*a* and is heated in the second heat exchange module 106 before exiting to the heating fluid-out pipeline 116*b*. Heat is absorbed from the source fluid in the third heat exchange module 108 as described above.

The valve 119*a* may be closed so that cooling fluid does not flow through the second heat exchange module 106, which is inactive in this mode.

Figure 7:
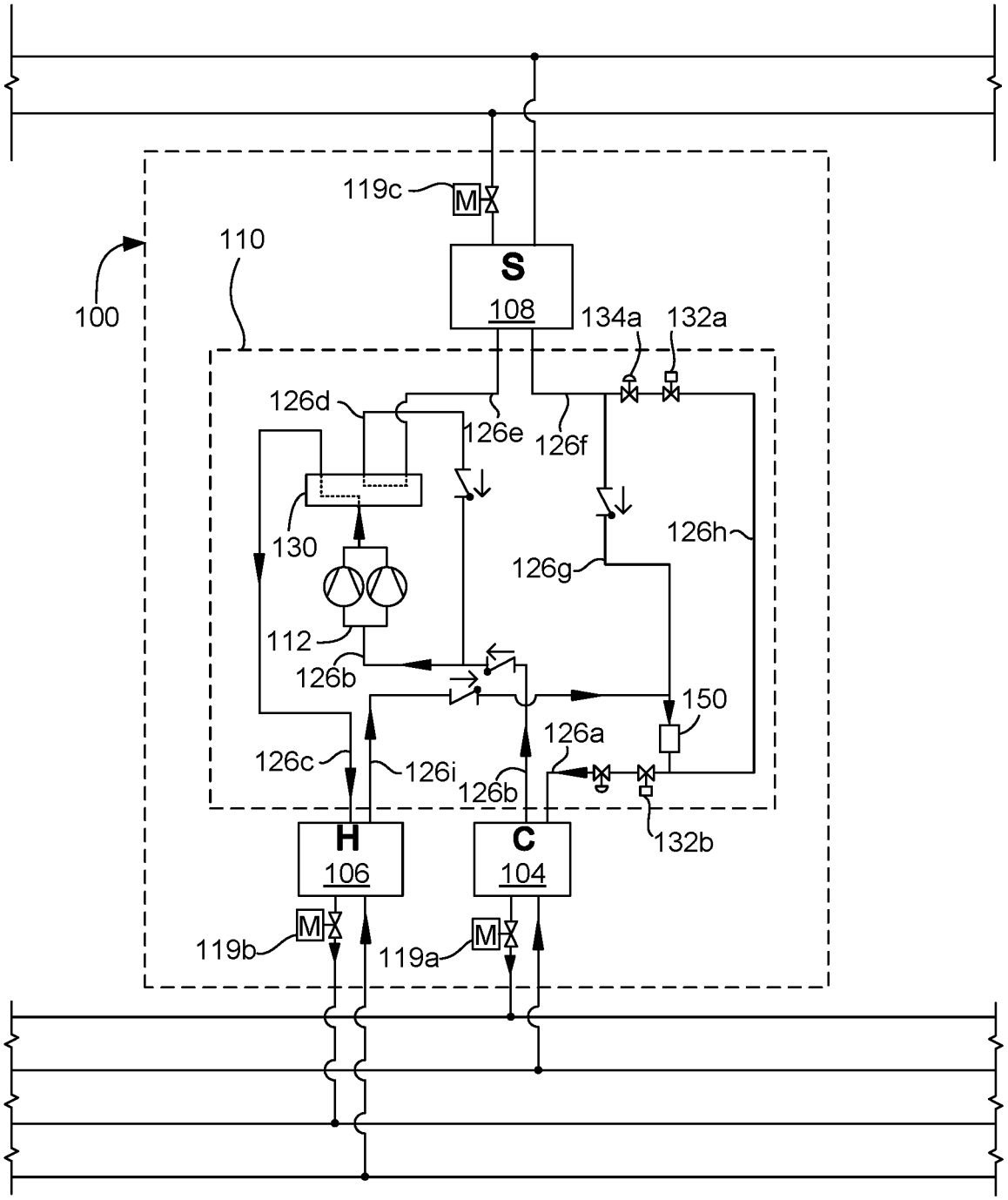
FIG. 7 is the block diagram of the apparatus of FIG. 1, but operating in a concurrent heating and cooling mode of operation.

FIG. 7 is the block diagram of FIG. 1, but in the concurrent heating and cooling configuration. In this mode of operation, the refrigerant line system 110 creates a refrigeration cycle using the first and second heat exchange modules 104 and 106 (with the third heat exchange module 108 inactive). Arrows on the relevant refrigerant line segments are shown to illustrate the direction of flow of the refrigerant fluid, heating fluid and source fluid.

The first solenoid valve 132*a* is closed to prevent refrigerant fluid from flowing through refrigerant line segment 126*h*. The second solenoid valve 132*b* is opened to allow flow through refrigerant line segment 126*a*. As a result, refrigerant in the boiling state (due to expansion valve 134*b*) flows into the first heat exchange module 104 where it evaporates in the first heat exchanger 136 (FIG. 2) and absorbs heat from the cooling liquid. The refrigerant fluid then exits the first heat exchange module 104 and travels to the compressor via refrigerant line segment 126*b* where it is compressed into a heated gas and continues on to the reversing valve 130.

In this mode, the reversing valve has the same "setting 2" configuration shown in FIG. 6, and thus directs the refrigerant fluid to line segment 126*c* and into the second heat exchanger. In the second heat exchanger 106, the refrigerant fluid travels through the second heat exchanger 142 (FIG. 3) and radiates heat, which is absorbed by the heating fluid.

In this concurrent heating and cooling mode of operation, the valves 119*a* and 119*b* are opened so that the cooling fluid and heating fluid flow through the first and second heat exchange modules 104 and 106 respectively. The valve 119*c* may be closed so that source fluid does not flow through the third heat exchange module 108, which is inactive in this mode.

A modular system may include multiple heating and cooling apparatuses of the type shown in FIGS. 1, 6 and 7. For a concurrent heating and cooling mode of operation, cooling requirements may be satisfied before heating requirements or vice versa. When cooling requirements are satisfied before the heating requirements, the system (e.g. system 1000 in FIG. 10) may activate additional apparatus(es) (i.e. module(s)) in the heating-only mode of operation to make up the additional required heating. In other cases, when heating requirements are satisfied before cooling, additional cooling may be provided by turning on one or more apparatuses for the cooling-only mode. Thus, the modular system described herein may provide flexibility for satisfying both heating and cooling demands at any time.

Optionally, the heating and cooling apparatus 100 has a standby mode of operation in which each of the valves 119*a*, 119*b* and 119*c* are closed to prevent cooling, heating and source fluid flow in the heating and cooling apparatus 100. The solenoid valves 132*a* and 132*b* in the line system 110 are also closed to prevent refrigerant fluid from flowing.

The apparatus 100 shown in FIGS. 1, 6 and 7 may further comprise a system for controlling one or more valves (such as the valves 119*a* to 119*c*, 130, 132*a*, 132*b*, 134*a* and/or 134*b*) in order to select between the various modes of operation described above.

Figure 8:
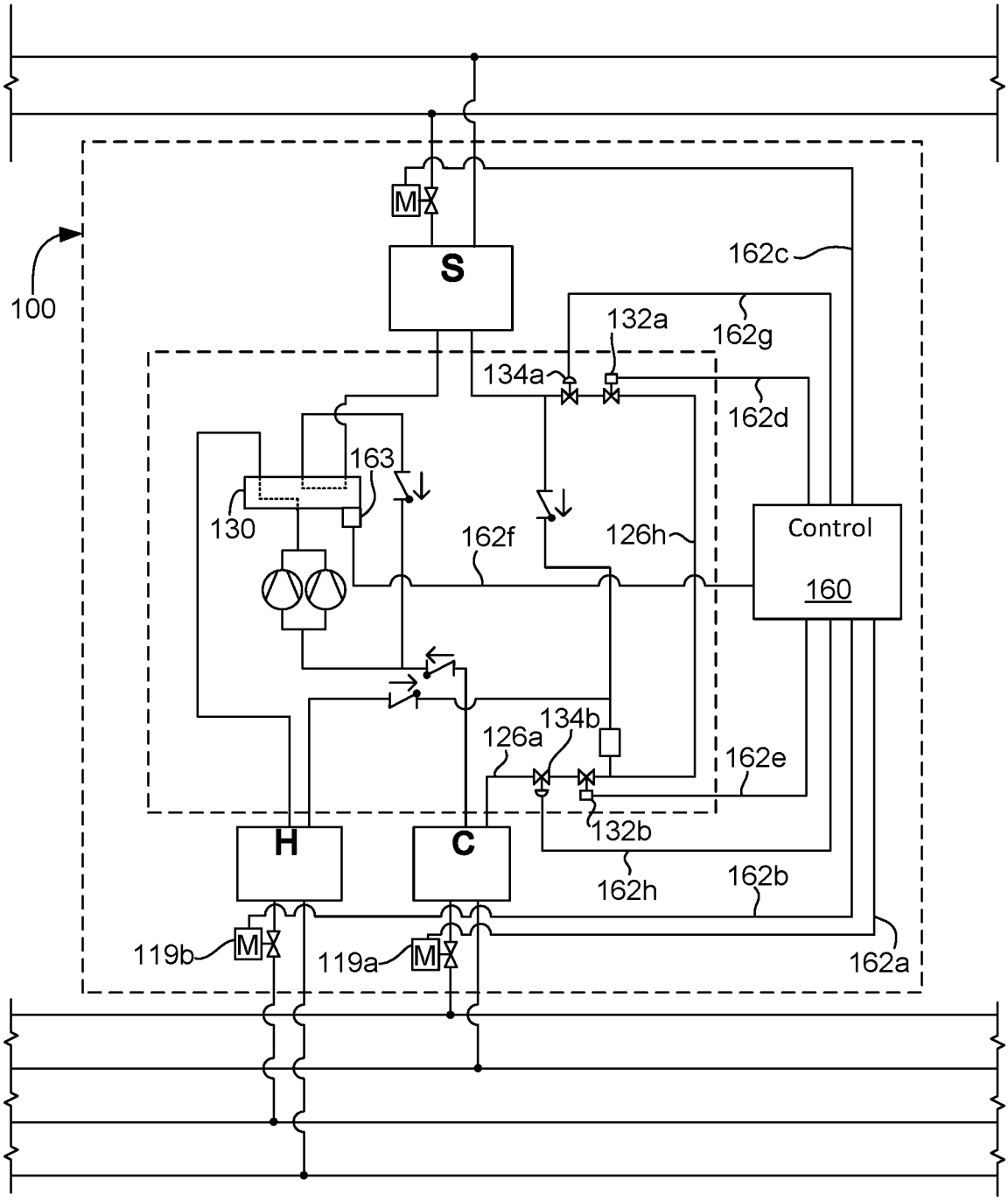
FIG. 8 is a block diagram of the heating and cooling apparatus of FIGS. 1, 6 and 7 and further including an example control module.

FIG. 8 is a functional block diagram of the heating and cooling apparatus 100 of FIGS. 1, 6 and 7 and further including an example control module 160. In this example, the control module 160 is operably connected to each of the valves 119*a* to 119*c*, 130, 132*a*, 132*b*, such that the control module can selectively open and close each of the valves 119*a* to 119*c*, 130, 132*a*, 132*b*. The valves 119*a* to 119*c*, 130, 132*a*, 132*b* may also have variable flow speed settings in addition to simply "open" to control flow rates as desired. In this embodiment, the control module 160 is also connected to the expansion valves 134*a*, 134*b* to properly adjust refrigerant flow expansion.

More specifically, the control module 160 is connected to the valve 119*a* by a first operable connection 162*a* to control the cooling fluid flow. The control module 160 is connected to the valve 119*b* by a second operable connection 162*b* to control the heating fluid flow. The control module 160 is connected to the valve 119*c* by a third operable connection 162*c* to control the source fluid flow. The control module 160 is connected to the solenoid valve 132*a* by a fourth operable connection 162*d* to control the refrigerant fluid flow through line segment 126*h* and expansion valve 134*a*. The control module 160 is connected to the solenoid valve 132*b* by a fifth operable connection 162*e* to control the refrigerant fluid flow through line segment 126*a* and expansion valve 134*b*. The control module 160 is connected to the reversing valve 130 by a sixth operable connection 162*f* to control the refrigerant fluid flow paths through reversing valve 130. In this example, the reversing valve is solenoid activated and the control module 160 is connected to the motor 163 of the reversing valve 130. The control module 160 is al connected to the expansion valves 134*a*, 134*b* by seventh and eighth operable connections 162*g* and 162*h* respectively.

The operable connections 162*a* to 162*f* may each comprise a wired electrical connection, a wireless connection, or a combination of the two, for example. Embodiments are not limited to any particular type of connection for controlling the valves 119*a* to 119*c*, 130, 132*a* and 132*b*. As mentioned above, the valves 119*a* to 119*c*, 132*a* and 132*b* in this example are each motorized, and the control module 160 may activate motors therein by electronic signals to open or close each valve 119*a* to 119*c*, 132*a* and 132*b*. Other types of valves that are controllable by remote control means may also be used.

In other embodiments, the valves 119*a* to 119*c* (shown in FIGS. 1 to 8) may be external to the heating and cooling apparatus 100 (FIGS. 1 and 6 to 8) and/or may be omitted. For example, the control module 160 may only control the valves 132*a*, 132*b* and 130, while heating, cooling and/or source fluid are controlled manually and/or by another electronic control system.

Figure 9:
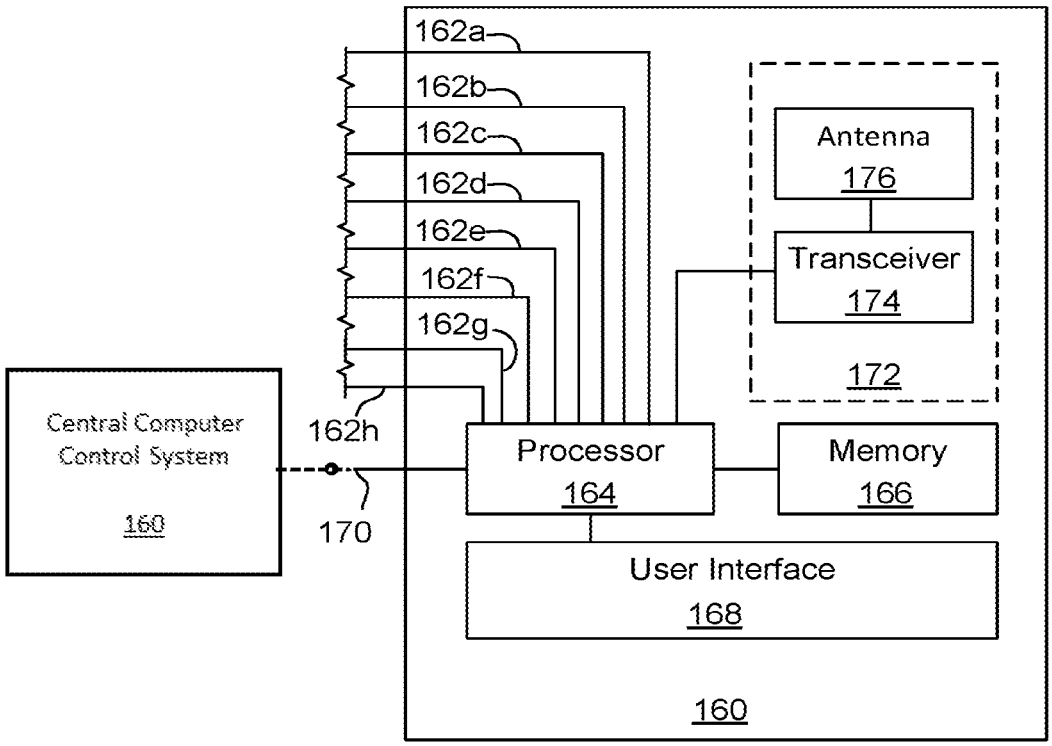
FIG. 9 is a block diagram showing additional detail of the example control module of FIG. 8.

FIG. 9 is a block diagram showing additional detail of the example control module 160 of FIG. 8. The control module 160 in this embodiment includes a processor 164 and a memory 166 coupled to the processor. The memory 166 may include processor executable instructions stored thereon for controlling the processor 164 to perform functionality described herein. In some embodiments, the memory 166 may be internal to the processor 164. The processor 164 is operably connected to the valves 119*a* to 119*c*, 132*a*, 132*b*, 134*a* and 134*b* (shown in FIG. 8) via the connections 162*a* to 162*h*.

In still other embodiments, one or more of the valves 119*a* to 119*c*, 132*a*, 132*b*, 134*a* and 134*b* may include its own computer processing means and/or memory for controlling the behavior of the valve. For example, one or more valves may be "smart valves" that are automatically responsive to one or more parameters such as user input, temperature/pressure data, signals from a control module of the apparatus or a remote computer system, etc. One or more valves may be in communication with each other and may be collectively configured to perform the controlling functionality described herein. In some embodiments, the one or more "smart valves" may communicate (e.g. wirelessly) with the control module 160, or the control module 160 may be omitted in still other embodiments.

The processor 164 of the control module 160 in this example controls the valves 119*a* to 119*c*, 130, 132*a* and 132*b* to provide the various modes of operation of the heating and cooling apparatus 100 (shown in FIGS. 1, 6 and 7) according to Table 1 below.

TABLE 1

| | Cooling Only | Heating Only | Concurrent Heat/Cool | Standby |
|---|---|---|---|---|
| Valve 119a (Cooling) | Open | Closed | Open | Closed |
| Valve 119b (Heating) | Closed | Open | Open | Closed |
| Valve 119c (Source) | Open | Open | Closed | Closed |
| Reversing Valve 130 setting | Setting 1 (FIG. 1) | Setting 2 (FIGS. 6, 7) | Setting 2 (FIGS. 6, 7) | N/A |
| Valve 132a (Refrigerant) | Closed | Open | Closed | Closed |
| Valve 132b (Refrigerant) | Open | Closed | Open | Closed |

The control module 160 in this example further includes an optional user interface 168 for receiving input from a user. By way of nonlimiting example, the user interface may be used to: program the behavior of the processor 164; cause the processor 164 to activate one of the modes of operation described above; and/or obtain diagnostic data.

The control module 160 in this example includes an optional wired input/output port 170 and an optional wireless communication subsystem 172, which are both operably connected to the processor 164. The example wireless communication subsystem 172 includes transceiver 174 connected to antenna 176 for wireless communication. The processor may also be operably connected to one or more other devices including, but not limited to: one or more thermostats; one or more temperature and/or pressure sensors; one or more other heating and cooling apparatuses (i.e. modules); and a central computer control system. Such connections may be established via the input/output port 170 and/or via wireless communication subsystem 172.

The processor 164 may optionally receive temperature, pressure and/or other signals or information from the temperature and/or pressure sensor(s) and/or may receive control signals from the thermostat(s). The processor 164 may be programmed to activate one or more of the modes of operation of the heating and cooling apparatus 100 based on such information. For example, the processor 164 may activate the heating-only mode if a temperature is below a threshold, and the processor 164 may activate the cooling-only mode if a temperature is below another threshold. A thermostat may cause similar actions by sending control signals to the processor 164.

The control module 160 may optionally be controlled by a remote central remote computer control system 165, which may communicate with the processor 164. The central computer control system 165 may control a plurality of heating and cooling apparatuses (modules) according to cooling and heating needs.

In some embodiments, a user may use the user interface 168 or a remote computer in communication with the control module 160 to set a required amount of heating-only, cooling-only, or concurrent heating and cooling. The system then activates each of the heating and cooling apparatus(es) to operate one of the modes depending on the system requirements. For example, one or more may be set to cooling-only; one or more may be set to heating-only; and one or more may be set to concurrent heating and cooling.

The control module 160 may optionally communicate with control modules of other heating and cooling apparatuses in the modular system in order to provide heating and cooling requirements in conjunction with the other heating and cooling apparatuses.

Figure 10:
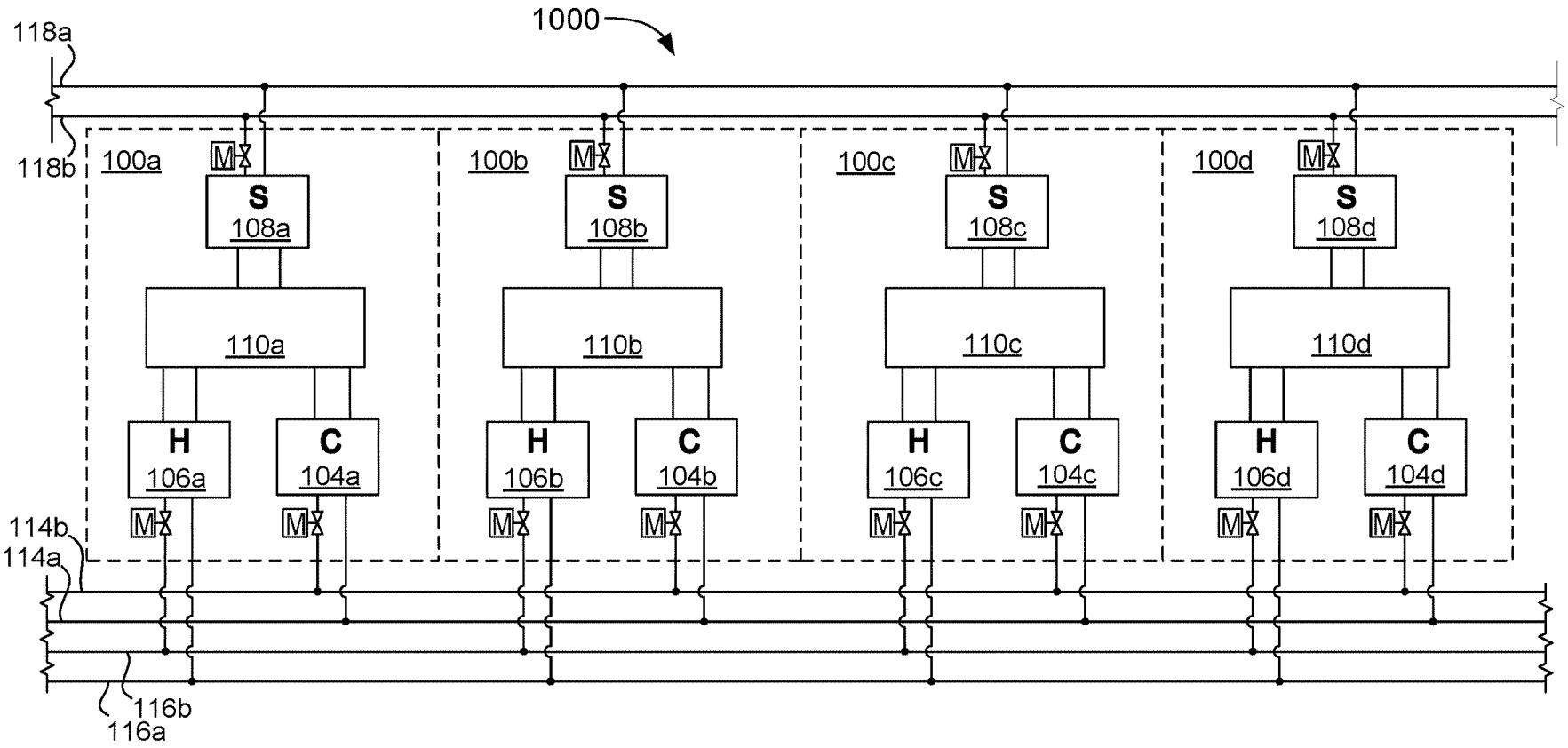
FIG. 10 is a functional block diagram of an example modular heating and cooling system according to some embodiments.

FIG. 10 is a functional block diagram of an example modular heating and cooling system 1000 according to some embodiments. The system 1000 comprises four heating and cooling apparatuses (i.e. modules) 100*a*, 100*b*, 100*c*, and 100*d*. Each of the heating and cooling apparatuses 100*a*, 100*b*, 100*c*, and 100*d* has a structure and function similar to the heating and cooling apparatus 100 shown in FIGS. 1, 6 and 7 and described above. More specifically, the first heating and cooling apparatus 100*a* includes respective first, second and third heat exchange modules 104*a*, 106*a*, and 108*a* and a refrigerant line system 110*a*. The first heat exchange module 104*a* is coupled to the cooling fluid-in pipeline 114*a* and the cooling fluid-out pipeline 114*b*. The second heat exchange module 106*a* is coupled to the heating fluid-in pipeline 116*a* and the heating fluid-out pipeline 116*b*. The third heat exchange module 108*a* is coupled to the source fluid-in pipeline 118*a* and the source fluid-out pipeline 114*b*.

The second heating and cooling apparatus 100*b* includes respective first, second and third heat exchange modules 104*b*, 106*b*, and 108*b* and a refrigerant line system 110*b*. The third heating and cooling apparatus 100*c* includes respective first, second and third heat exchange modules 104*c*, 106*b*, and 108*c* and a refrigerant line system 110*c*. The fourth heating and cooling apparatus 100*d* includes respective first, second and third heat exchange modules 104*d*, 106*d*, and 108*d* and a refrigerant line system 110*d*. Each of the second, third and fourth second heating and cooling apparatuses 100*b* to 100*d* are similarly connected to the cooling fluid-in pipeline 114*a*, cooling fluid-out pipeline 114*b*, the heating fluid-in pipeline 116*a*, heating fluid-out pipeline 116*b*, and the source fluid-in pipeline 118*a*, source fluid-out pipeline 118*b*.

The first heat exchange modules 104*a* to 104*d*, the second heat exchange modules 106*a* to 106*d*, the third heat exchange modules 108*a* to 108*d* and the refrigerant line systems 110*a* to 110*d* have similar structure and functionality as the corresponding modules shown in FIGS. 1 to 7 and described above.

The heating and cooling apparatuses 100*a*, 100*b*, 100*c*, and 100*d* may also each include a respective control module, similar to control module 160 shown in FIGS. 8 and 9, for controlling their heating and cooling functions. The heating and cooling apparatuses 100*a*, 100*b*, 100*c*, and 100*d* may all be in communication with a central control system (e.g. a remote computer system) and/or in communication with each other.

Each of the heating and cooling apparatuses 100*a*, 100*b*, 100*c*, and 100*d* may be independently set to a mode of operation including: cooling-only; heating-only; and concurrent heating and cooling, as described above. Other modes, such as standby, may also be selectable in some embodiments. The number of heating and cooling apparatus modules in a modular system (such as system 1000) may vary.

Figure 11:
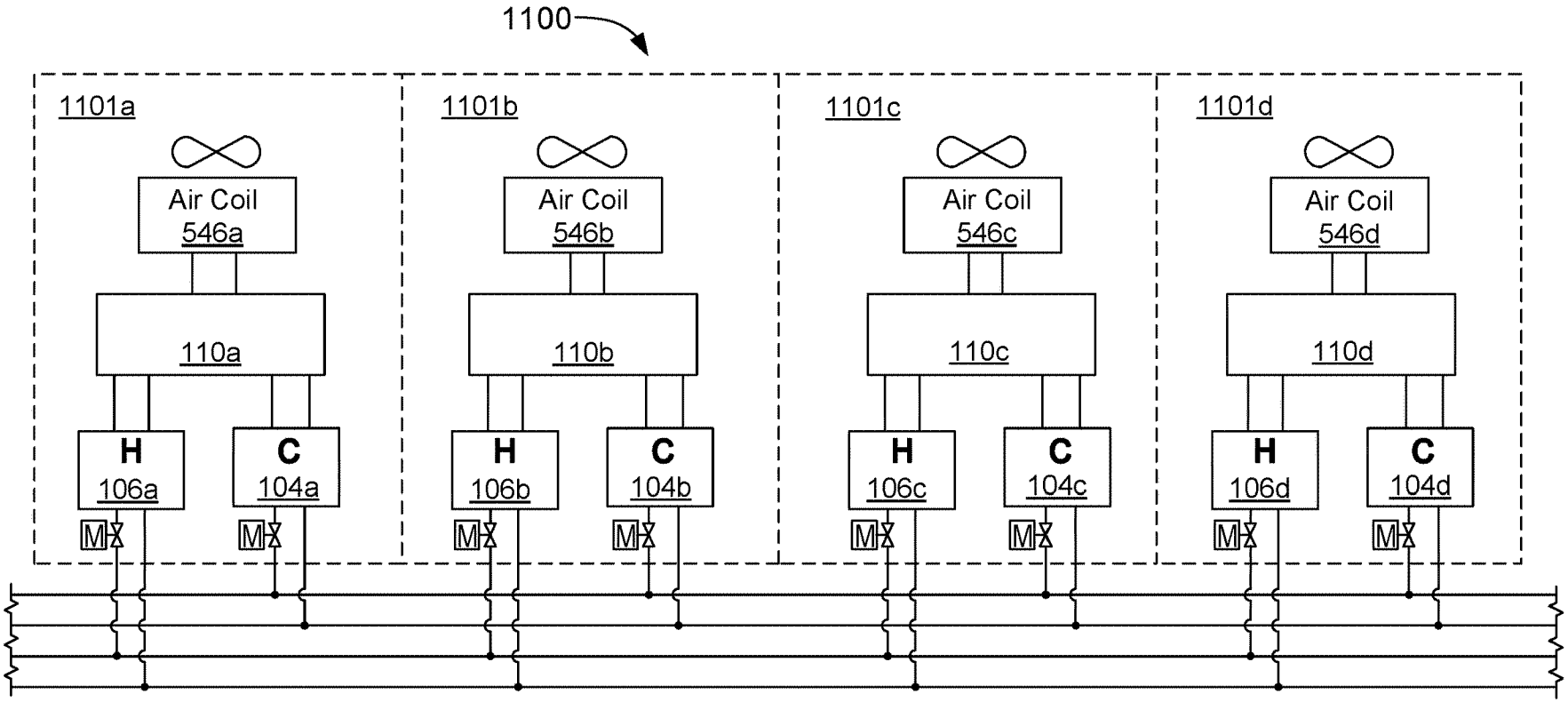
FIG. 11 is a functional block diagram of another example modular heating and cooling system according to some embodiments.

FIG. 11 is a functional block diagram of another example modular heating and cooling system 1100 according to some embodiments. The system 1100 is similar to the system 1000 shown in FIG. 10. However, rather than a third heat exchanger thermally couple to a source fluid line, the heating and cooling apparatuses 1100*a* to 1100*d* of the system 1100 each include a respective air coil heat exchanger 546*a*, 546*b*, 546*c* or 546*d*. The air coil heat exchanger 546*a*, 546*b*, 546*c* and 546*d* each have a structure and function similar to the air coil heat exchanger 546 in FIG. 5.

The heating and cooling apparatuses 1100*a* to 1100*d* of the system 1100 also include first heat exchange modules 104*a* to 104*d*, second heat exchange modules 106*a* to 106*d* and refrigerant line systems 110*a* to 110*d* that are similar to those shown in FIG. 10.

Figure 12:
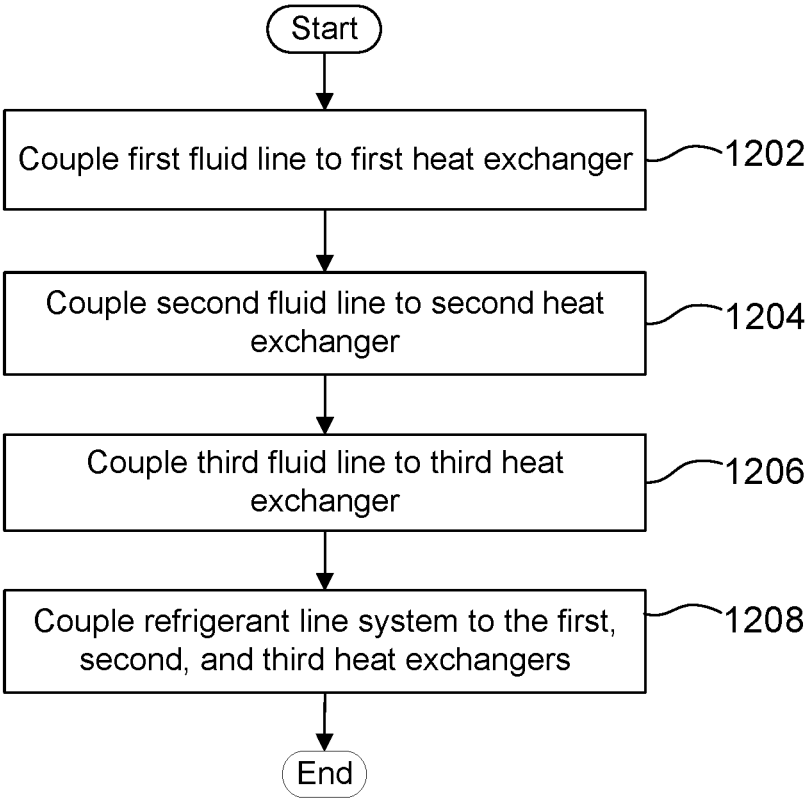
FIG. 12 is a flowchart of a method for making a heating and cooling apparatus according to some embodiments.

FIG. 12 is a flow chart of a method for making a heating and cooling apparatus according to some embodiments. The apparatus may be similar to the apparatus 100 shown in FIGS. 1, 6 and 7.

At block 1202, a first fluid line is coupled to a first heat exchanger. The first fluid line may, for example, for a cooling fluid line, and the first heat exchanger may be configured for cooling the fluid in the cooling fluid line.

At block 1204, a second fluid line is coupled to a second heat exchanger. The first fluid line may, for example, for a heating fluid line, and the second heat exchanger may be configured for heating the fluid in the heating fluid line. The first fluid line and the second fluid line may be independent and separate from the one another, thereby maintaining separation of the first and second fluids.

At optional block 1206, the method further comprises coupling a third (e.g. source) fluid line to a third heat exchanger. However, the third heat exchanger may be an air coil heat exchanger without a third fluid line in some embodiments.

At block 1208, a refrigerant line system is coupled to the first, second heat and the third heat exchanger. The refrigerant line system is configurable for selectively directing refrigerant fluid through: the first and third heat exchangers and a compressor for cooling the first fluid in a first mode of operation; the second and third heat exchangers and the compressor for heating the second fluid in a second mode of operation; and the first and second heat exchangers and the compressor for cooling the first fluid and heating the second fluid a for a third mode of operation. The refrigerant line system may be similar in function and structure to the example refrigerant line system 110 shown in FIGS. 1, 6 and 7. However, it is to be understood that the refrigerant line system may comprise other arrangements of fluid lines, valves and/or switches to perform the function of providing different refrigerant loops for the different modes of operation.

It is to be understood that the order of blocks 1202, 1204, 1206 and 1208 shown in FIG. 12 and described above are not necessarily in chronological order. Step 1208 may be performed before steps 1202, 1204 and 1206. Similarly, embodiments are not limited to any particular order for coupling the first, second and third heat exchangers to the corresponding first, second and third fluid lines.

More specifically, for the first mode of operation, the refrigerant line system is configured to direct the refrigerant through the third heat exchanger in a first flow direction such that the third heat exchanger functions as a heat sink. For the second mode of operation, the refrigerant line system is configured to direct the refrigerant through the third heat exchanger in a first flow direction such that the third heat exchanger functions as a heat source.

The method may further comprise making the refrigerant line system by interconnecting a plurality of refrigerant line segments and a plurality of valves to provide the refrigerant line system that provides a first refrigerant loop for the first mode of operation; a second refrigerant loop for the second mode of operation; and a third refrigerant loop for the third mode of operation. The refrigerant line system may be similar to the refrigerant line system 110 described above with reference to FIGS. 1, 6 and 7.

The method may further comprise connecting one or more valves of the refrigerant line system to a control module (such as the example control module 160 shown in FIGS. 8 and 9).

Figure 13:
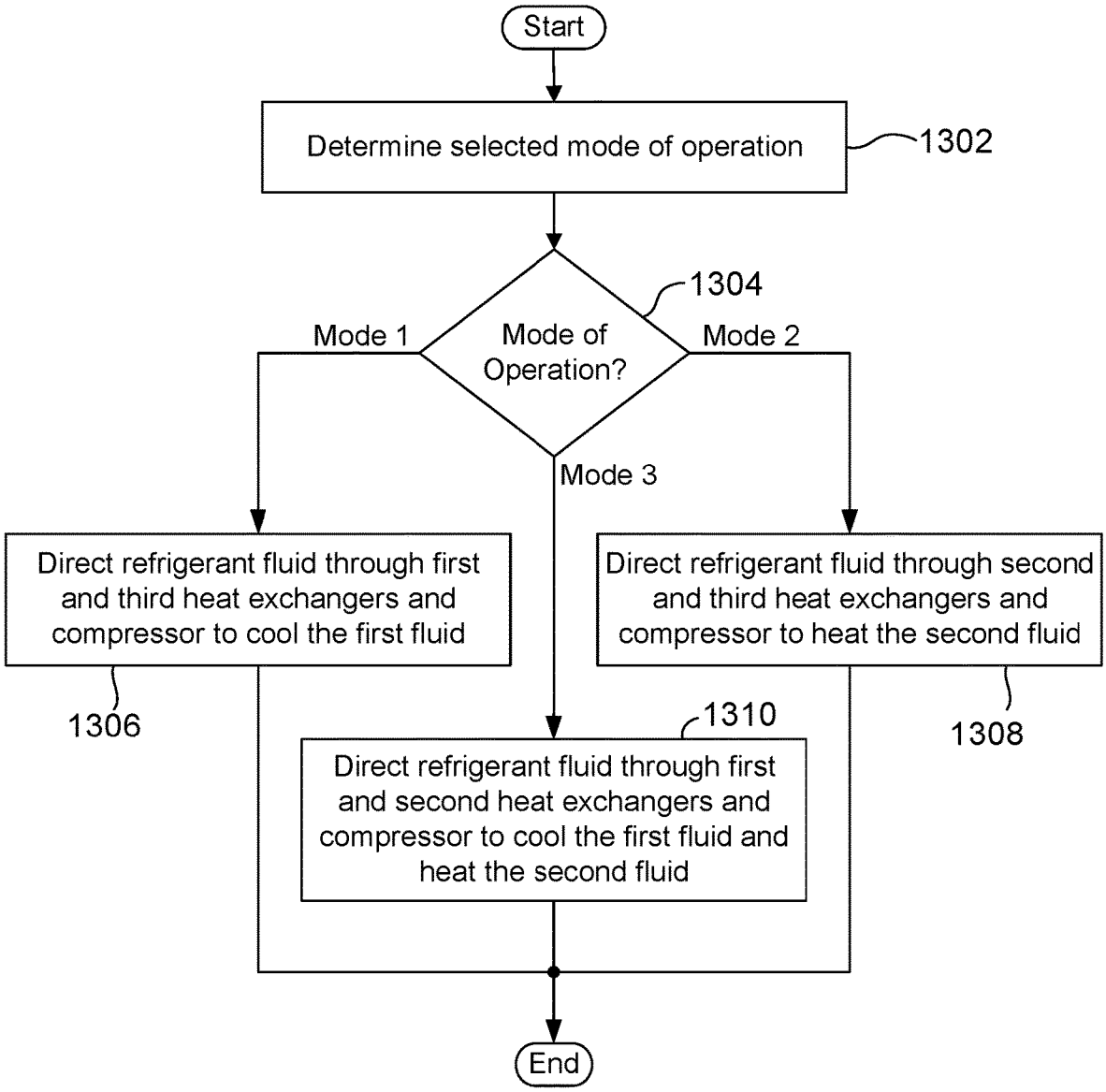
FIG. 13 is a flowchart of a method according to yet another embodiment.

FIG. 13 is a flowchart of a method according to yet another embodiment. The method of FIG. 13 may, for example, be implemented by a control module (e.g. control module 160 of FIGS. 8 and 9) of a heating and cooling apparatus (e.g. apparatus 100 in FIGS. 1, 6 and 7) as described herein or by a remote computer control system connected to the apparatus. The apparatus in this method comprises a first heat exchanger; a second heat exchanger; a third heat exchanger; a compressor; a first fluid line for a first fluid coupled to the first heat exchanger; a second fluid line for a second fluid coupled to the second heat exchanger; and a refrigerant line system coupled to the first, second and third heat exchangers and configurable for selectively directing refrigerant fluid as described below. In this example, the first fluid is a cooling fluid, the second fluid is a heating fluid, and the third fluid is a source fluid.

At block 1302, a selected mode of operation for the apparatus is determined. Determining the selected mode of operation may comprise receiving an indication of the selected mode of operation as user input (e.g. receiving the input via a user interface). Alternatively, determining the selected mode of operation may comprise selecting the mode of operation as a function of received data (e.g. temperature and/or pressure date). As yet another example, the determining may comprise receiving a signal from a remote computer system that comprises an indication of the mode of operation. Other methods of determining the selected mode of operation are also possible. The method then continues at block 1304.

In some embodiments, the method further comprises, after block 1302, determining whether the selected mode of operation is different than a current mode of operation. If not, the method may end. If so, the method may continue to block 1304.

If the selected mode of operation is a first mode of operation ("mode 1" branch, block 1304), then at block 1306 the refrigerant line system is configured to direct refrigerant fluid through the first and third heat exchangers and the compressor, to cool the first fluid. Optionally, the step of block 1306 further comprises starting flow of the first fluid in the first fluid line and/or starting flow of the third fluid in the third fluid line. The step may further comprise stopping flow of the second fluid in the second fluid line.

If the mode of operation is a second mode of operation ("mode 2" branch, block 1304), then at block 1308 the refrigerant line system is configured to direct refrigerant fluid through the second and third heat exchangers and the compressor, to heat the second fluid. Optionally, the step of block 1308 further comprises starting flow of the second fluid in the second fluid line and/or starting flow of the third fluid in the third fluid line. The step may further comprise stopping flow of the first fluid in the first fluid line.

If the mode of operation is a third mode of operation ("mode 3" branch, block 1304), then at block 1310 the refrigerant line system is configured to direct refrigerant fluid through the first and second heat exchangers and the compressor, to both cool the first fluid and heat the second fluid. Optionally, the step of block 1310 further comprises starting flow of the first fluid in the first fluid line and/or starting flow of the second fluid in the second fluid line. The step may further comprise stopping flow of the third fluid in the third fluid line.

The method may also comprise, for a fourth, standby mode of operation, in which the flow in each of the first, second and third fluid lines is stopped as well as the flow of the refrigerant in the refrigerant line system.

Configuring the refrigerant line system may comprise controlling one or more valves in the refrigerant line system (such as the refrigerant line system 110 of FIGS. 1, 6 and 7, for example) to provide different refrigerant loops for the first, second and third modes of operation.

It is to be understood that a combination of more than one of the approaches described above may be implemented. Embodiments are not limited to any particular one or more of the approaches, methods or apparatuses disclosed herein. One skilled in the art will appreciate that variations, alterations of the embodiments described herein may be made in various implementations without departing from the scope of the claims.

The invention claimed is:

1. A heating and cooling apparatus comprising: a plurality of heating and cooling modules, each of the heating and cooling modules including:

a first heat exchanger, a second heat exchanger and a third heat exchanger;

a compressor;

a first fluid line for a first fluid coupled to the first heat exchanger;

a second fluid line for a second fluid coupled to the second heat exchanger;

a refrigerant line system coupled to the first, second and third heat exchangers and configured to:

direct refrigerant fluid through a cooling circuit where heat exchangers selected from the first heat exchanger, the second heat exchanger, and the third heat exchanger included in the cooling circuit are the first and third heat exchangers and not the second heat exchanger, the cooling circuit including the compressor, to cool the first fluid, in a first mode of operation;

direct the refrigerant fluid through a heating circuit where heat exchangers selected from the first heat exchanger, the second heat exchanger, and the third heat exchanger included in the heating circuit are the second and third heat exchangers and not the first heat exchanger, the heating circuit including the compressor, to heat the second fluid, in a second mode of operation;

direct the refrigerant fluid through a heating and cooling circuit where the heat exchangers selected from the first heat exchanger, the second heat exchanger, and the third heat exchanger included in the heating and cooling circuit are the first and second heat exchangers and not the third heat exchanger, the heating and cooling circuit including the compressor, to cool the first fluid and heat the second fluid, in a third mode of operation; and a central control system configured to operate the plurality of heating and cooling modules such that one or more heating and cooling modules of the plurality of heating and cooling modules operate in one of the first mode of operation, the second mode of operation, and the third mode of operation.

2. The heating and cooling apparatus of claim 1, wherein:

the refrigerant line system is configured to, in the first mode of operation, to direct the refrigerant through the third heat exchanger in a first flow direction such that the third heat exchanger functions as a heat sink; and the refrigerant line system is configured to, in the second mode of operation, to direct the refrigerant through the third heat exchanger in a second flow direction such that the third heat exchanger functions as a heat source.

3. The heating and cooling apparatus of claim 1, wherein the first fluid line and the second fluid line are independent and separate from one another, thereby maintaining separation of the first and second fluids.

4. The heating and cooling apparatus of claim 1, wherein:

the first fluid line comprises a first fluid input connectable to a first fluid-in pipeline and a first fluid output connectable to a first fluid-out pipeline; and the second fluid line comprises a second fluid input connectable to a second fluid-in pipeline and a second fluid output connectable a second fluid-out pipeline.

5. The heating and cooling apparatus of claim 1, wherein the heating and cooling apparatus is further operable in a standby mode of operation.

6. The heating and cooling apparatus of claim 1, wherein each of the first and second fluid lines comprises a respective valve to control flow therethrough.

7. The heating and cooling apparatus of claim 1, further comprising a control module connected to the refrigerant line system and operable to select between the modes of operation.

8. The heating and cooling apparatus of claim 7, wherein the refrigerant line system comprises a plurality of interconnected refrigerant line segments and a plurality of valves configurable to provide: a first refrigerant loop for the first mode of operation; a second refrigerant loop for the second mode of operation; and a third refrigerant loop for the third mode of operation.

9. The heating and cooling apparatus of claim 8, wherein the control module is connected to and controls the plurality of valves.

10. The heating and cooling apparatus of claim 1, wherein the first mode of operation is a cooling-only mode of operation, the second mode of operation is a heating-only mode of operation, and the third mode of operation is a concurrent heating and cooling mode of operation.

11. The heating and cooling apparatus of claim 1, wherein the third heat exchanger is an air coil heat exchanger.

12. The heating and cooling apparatus of claim 1, further comprising a third fluid line, for a third fluid, coupled to the third heat exchanger such that the third fluid absorbs heat from the refrigerant fluid in the first mode of operation and the third fluid provides heat to the refrigerant fluid in the second mode of operation.

13. The heating and cooling apparatus of claim 12, wherein at least one of the first, second and third fluids is glycol free water, and at least one other of the first, second and third fluids is a glycol solution.

14. The heating and cooling apparatus of claim 12, wherein at least one of the first, second and third fluid lines comprises a respective cleanable strainer upstream of the corresponding first, second or third heat exchanger.

15. The heating and cooling apparatus of claim 1, wherein each of the plurality of heating and cooling modules is connected to a first fluid-in pipeline, a first fluid-out pipeline, a second fluid-in pipeline and a second fluid-out pipeline.

16. The heating and cooling apparatus of claim 15, each of the plurality of heating and cooling modules further comprising a third fluid line for a third fluid, coupled to the third heat exchanger such that the third fluid absorbs heat from the refrigerant fluid in the first mode of operation and the third fluid provides heat to the refrigerant fluid in the second mode of operation, wherein the third fluid line is connectable to a third fluid-in pipeline, and a third fluid-out pipeline.

17. The heating and cooling apparatus of claim 15, wherein a current mode of operation of the plurality of modes of operation is independently selectable for each of the plurality of heating and cooling modules.

18. A method for making a heating and cooling apparatus comprising: making a plurality of heating and cooling modules by a method including:

providing a first heat exchanger;

providing a second heat exchanger;

coupling a refrigerant line system to the first and second heat exchangers and to a third heat exchanger, wherein the refrigerant line system is configured to:

direct refrigerant fluid through a cooling circuit where heat exchangers selected from the first heat exchanger, the second heat exchanger, and the third heat exchanger included in the cooling circuit are the first and third heat exchangers and not the second heat exchanger, the cooling circuit including a compressor, for cooling a first fluid, in a first mode of operation;

direct the refrigerant fluid through a heating circuit where heat exchangers selected from the first heat exchanger, the second heat exchanger, and the third heat exchanger included in the heating circuit are the second and third heat exchangers and not the first heat exchanger, the heating circuit including the compressor, for heating a second fluid, in a second mode of operation; and direct the refrigerant fluid through a heating and cooling circuit where heat exchangers selected from the first heat exchanger, the second heat exchanger, and the third heat exchanger included in the heating and cooling circuit are the first and second heat exchangers and not the third heat exchanger, the heating and cooling circuit including the compressor, for cooling the first fluid and heating the second fluid, for a third mode of operation, coupling the first heat exchanger of each of the plurality of heating and cooling modules to a first fluid line for a first fluid; and coupling the second heat exchanger of each of the plurality of heating and cooling modules to a second fluid line for a second fluid.

19. The method of claim 18, further comprising:

for the first mode of operation, configuring the refrigerant line system to direct the refrigerant through the third heat exchanger in a first flow direction such that the third heat exchanger functions as a heat sink; and for the second mode of operation, configuring the refrigerant line system to direct the refrigerant through the third heat exchanger in a second flow direction such that the third heat exchanger functions as a heat source, the second flow direction being the reverse of the first flow direction.

20. The method of claim 18, wherein the first fluid line and the second fluid line are independent and separate from one another, thereby maintaining separation of the first and second fluids.

21. The method of claim 18, further comprising interconnecting a plurality of refrigerant line segments and a plurality of valves to provide the refrigerant line system having a first refrigerant loop for the first mode of operation; a second refrigerant loop for the second mode of operation; and a third refrigerant loop for the third mode of operation.

* * * * *